United States Patent [19]

Bick et al.

[11] 4,351,055

[45] Sep. 21, 1982

[54] WATER COOLED WALL ELEMENT FORMED OF TUBES FOR MELTING FURNACES

[75] Inventors: Klaus Bick, Paderborn; Lothar Harmsen, Lingen; Jürgen Zieschang, Lingen; Friedhelm Vennmann, Lingen, all of Fed. Rep. of Germany

[73] Assignee: Benteler Werke AG, Paderborn, Fed. Rep. of Germany

[21] Appl. No.: 133,139

[22] Filed: Mar. 24, 1980

[30] Foreign Application Priority Data

Aug. 16, 1979 [DE] Fed. Rep. of Germany ..... 2913092

[51] Int. Cl.[3] ..... F27D 1/12

[52] U.S. Cl. ..... 373/76

[58] Field of Search ..... 13/32, 35; 432/238

[56] References Cited

U.S. PATENT DOCUMENTS 3,940,552 2/1976 Mizuno ..... 13/32 X
4,122,295 10/1978 Nanjyo et al. ..... 13/32
4,206,312 6/1980 Kuhlmann ..... 13/32
4,207,060 6/1980 Zangs ..... 13/32 X
4,221,922 9/1980 Okimune ..... 13/32

*Primary Examiner*—Roy N. Envall, Jr.
*Attorney, Agent, or Firm*—Michael J. Striker

[57] ABSTRACT

A water cooled wall element for at least partially replacing the casing of refractory material in melting furnaces, especially electric arc furnaces for melting steel, above the bath of molten material in the furnace comprises a plurality of parallel, horizontally extending and vertically superimposed tubes abutting against each other, a cooling water inlet connected to the lowermost of the superimposed tubes, a cooling water outlet connected to the uppermost tube, and return bends connecting the ends of proximal tubes to each other so that the cooling water will flow from the cooling water inlet through the plurality of superimposed tubes to the cooling water outlet, wherein elongated substantially uninterrupted protrusions are provided on each of the tubes and extending in the longitudinal direction thereof on that surface of the wall element which is directed toward the interior of the surface to increase adhesion of an insulating layer of refractory material to be applied to the inner surface of the wall element.

11 Claims, 14 Drawing Figures

WATER COOLED WALL ELEMENT FORMED OF TUBES FOR MELTING FURNACES

BACKGROUND OF THE INVENTION

The present invention relates to a water cooled wall element formed from tubes, which in melting furnaces, preferably electric arc furnaces for melting of steel, replaces completely or in part the casing of refractory material in the region of the furnace above the bath of molten material therein.

The casing of refractory material in the region of arc furnaces above the bath of molten material therein has in the last years increasingly replaced by water cooled wall elements. The advantages of such constructions with respect to forming, the upper part of the furnace from refractory material consists in lowering the operating cost for the furnace as well as in the increase of the useful life of the furnace and the resulting decrease of time for necessary repair.

Since such wall elements formed from water cooled tubes can be dimensioned thinner than the up to now used stones of refractory material, there results also an enlargement of the inner diameter of the furnace in the upper region thereof and therewith also an advantageous increases of the charging volume.

A great number of constructions have in the meantime become known, which are essentially determined by two requirements.

One the one hand, the cooling water should cool all surface regions impinged by heat in a uniform manner, and, on the other hand, these surface regions should be constructed to provide good adhesion for layers of refractory material applied to these surface regions, as well as good adhesion for slag thrown from the molten bath onto the wall element.

The uniform cooling is essential for the useful life of the wall elements since, by not or insufficiently cooled regions and overheating of the same, a premature wear of the element will result. The insulating layer of refractory material, respectively the splattering of slag prevents too high thermic loading of the wall elements, as well as a too high heat transmission to the cooling water.

Requirement for uniform cooling is best accomplished by wall elements which consist of an endless coil of pipe. Such a system is described in the magazine "Fachberichte", volume 2, 1978, on pages 77–82.

This system has the advantage to provide, due to the enforced guiding of the cooling water, a uniform cooling, but this system has the disadvantage that the smooth tube wall provides a poor adhesion for a refractory layer and a splattering of slag. The construction of heat insulating protecting layers is impeded and any protective layers which have been applied peel off easily again and the thus unprotected tube carries off large amounts of heat in an uncontrolled manner to the cooling water.

The known wall elements for box-type design have therefore on the surface directed to the interior of the furnace differently shaped projections or indentations which provide good adhesion for the refractory mass, respectively, the splattering of slag. Elements of this construction are for instance disclosed in the DE OS 25 02 712, DE AS 26 59 827, as well as in DE AS 28 25 536.

The disadvantage of these constructions is the insufficient guiding of the cooling water, respectively, the necessary expense to assure a sufficient guiding of the cooling water.

Combinations of the two constructions are also known in which, for instance, water cooled tubes are inserted in corresponding channels on the rear side of cast metal plates, the front side of which is provided with ribs.

Since the heat transmission from the cast plate to the tubes is relatively poor, these tubes are connected by a heat conductive mass with the plate. These elements are to be used in shaft furnaces with relatively low temperatures.

In another combination, the element comprises a cast iron or copper block and a coiled pipe cast in the block as well as refractory stones, one half of which is cast in the block while the other half protrude beyond the latter. Such an element is expensive to manufacture, especially if the block is formed of copper. Such a copper block has the further disadvantage that it transmits a great amount of heat to the cooling water. If the blcok is formed of cast iron, its durability is limited and after melting of the cast iron body the cooling tube will be exposed, resulting in the disadvantage of a too high heat loss.

SUMMARY OF THE INVENTION

It is an object of the present invention to provide a water cooled wall element formed from tubes for melting furnaces, especially arc furnaces for melting steel, which avoids the disadvantages of such water cooled wall elements known in the art.

It is a further object of the present invention to provide a water cooled wall element of the aforementioned kind which may be constructed at relatively small cost, and which has as compared with such wall elements known in the art, an extended useful life.

With these and other objects in view, which will become apparent as the description proceeds, the water cooled wall element according to the present invention for at least partly replacing the casing of refractory material in melting furnaces, especially in electric arc furnaces for melting steel, above the bath of molten material in the furnace, mainly comprises a plurality of parallel, horizontally extending superimposed tubes engaging each other, a cooling water inlet means connected to the lowermost of the superimposed tubes, cooling water outlet means connected to the uppermost of the superimposed tubes, return bends connecting the ends of proximal tubes to each other, and especially horizontally extending essentially uninterrupted protrusions provided on that surface of the wall element which is directed toward the interior of the furnace. The horizontally extending protrusion may be formed by fins of seamless fin tubes.

On the other hand, these protrusions may be formed by fins welded to and extending longitudinally of the tubes. The profile of the fin to be welded to the tube may be sharp edged and the relation of its width to its thickness can be chosen in such a manner that the profile will improve adhesion of a layer of refractory material and splattering of slag thereonto. Such fins may be welded to the tube so as to extend in horizontal direction or at an angle of 20° upwardly toward the interior of the furnace.

The return bends which connect the ends of adjacent tubes to each other are usually formed from cast iron or steel and they are also provided at the side of the wall element which faces the interior of the furnace with fins.

According to the present invention, the horizontally extending substantially uninterrupted protrusions may also be formed by using rectangular tubes which are offset with respect to each other.

In such a construction each second one of the superimposed rectangular tubes may be offset to at least a quarter of its width toward the interior of the melting oven.

An improved construction will result wherein the uninterrupted protrusions are formed by a stepwise offsetting of the rectangular tubes in such a manner that the inside diameter of the upper region of the oven increases stepwise in upward direction.

According to the present invention the tubes provided with fins directed to the interior of the oven may also be connected in such a manner that any adjacent two tubes are connected to different cooling water circuits. This will require two cooling water inlets and two cooling water outlets, but this construction makes it possible to use return bends of commercially available construction.

The novel feature which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 3:
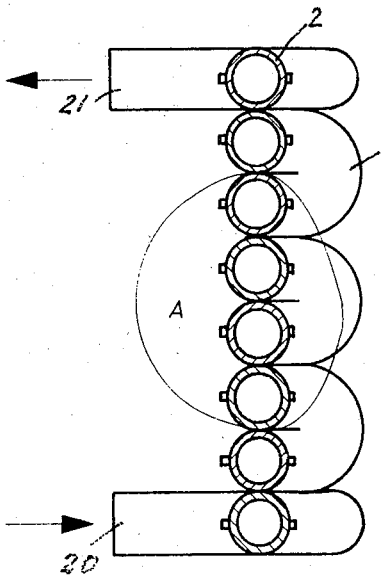
FIG. 3 is a section taken along the line III—III of FIG. 1.

Referring now to the drawing, and more specifically to FIGS. 1–4 of the same, it will be seen that the water cooled wall element 1 according to the present invention for the upper portion of a melting furnace, especially an arc furnace for melting steel, is composed of a plurality of vertically superimposed horizontally extending tubes 2 in which abutting tubes are connected by return bends 6 and in which the lowermost of the superimposed tubes is provided with a cooling water inlet 20, as best shown in FIG. 3, and the uppermost of the superimposed tubes is provided with a cooling water outlet 21. As can be seen from FIG. 2, the tubes 2 are slightly curved according to the curvature of the interior of the furnace.

The furnace itself, which is not illustrated in the drawing is of well-known construction, as for instance disclosed in the copending application Ser. No. 082,753 to Bick et al., in which however, different elements are shown for the portion of the furnace above the bath of molten material therein.

Figure 4:
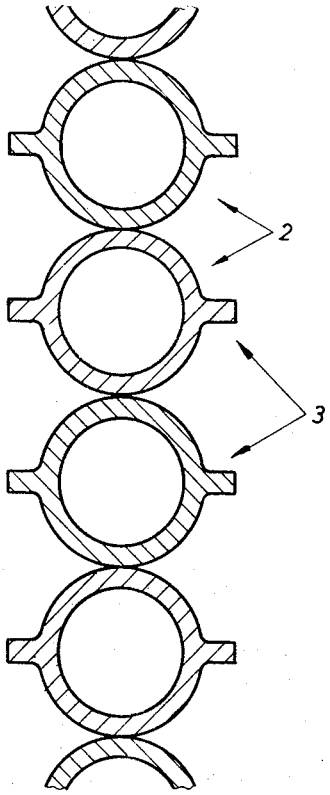
FIG. 4 is a vertical section of the region A shown in FIG. 3 in which the tubes are formed of seamless fin tubes.

In the embodiment shown in FIGS. 1–4 the tubes 2 forming the wall element 1 are constituted, as best shown in the section illustrated in FIG. 4, by tubes provided on opposite sides with horizontally extending fins 3. The horizontally extending uninterrupted fins 3 which are directed to the interior of the furnace form continuous protrusions which essentially improve the adhesion of layers of refractory material which is to be applied to the surface of the wall element 1 which is directed to the interior of the furnace, as well as the adhesion of slag splattered during operation of the furnace onto the inner surface of the wall element 1. The fins 3 are integrally formed with the tubes. In the embodiment of the wall element partially shown in FIG. 5 the cooling tubes 5 are provided with horizontal fins 4 extending in longitudinal direction of the tube and being welded thereto. These special cooling tubes are usually produced in a continuous welding process from circular tubes 5. Tubes of this kind are extensively used in the manufacture of boilers. The fin tubes 2 and the tubes 5 are preferably tubes made of heat resisting steel as used for superheated boiler tubes.

Figure 5:
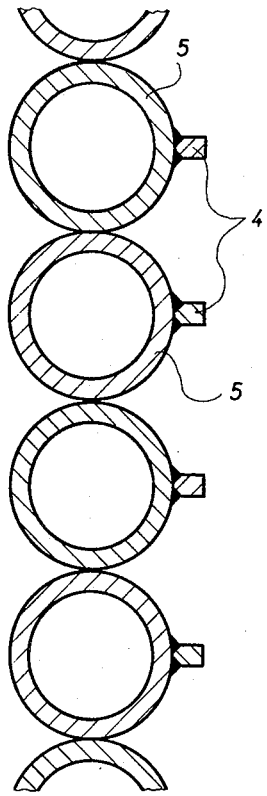
FIG. 5 is a section similar to FIG. 4, in which the tubes are provided with fins welded thereto.

The seamless fin tubes 2, as shown in FIG. 4, have the advantage that the tubes and the fins 3 thereon may be integrally formed, however, also the welded construction, as shown in FIG. 5, has certain advantages with regard of the application thereof in the wall element. As mentioned before the longitudinally extending horizontally arranged fins which are directed toward the interior of the furnace, serve especially to improve the adhesion of a layer of refractory material to be applied to the tubes, as well as the adhesion of slag splattered thereagainst during operation of the furnace. In the embodiment shown in FIG. 5, the outer edges of the fins 4 can be made very sharp and the relation of the width of the fins to the thickness thereof may be chosen in such a manner that the adhesion characteristic is further improved.

In the embodiment shown in FIG. 5 it is also possible to connect the tubes 5 of the wall elements in such a manner that the fins which are directed toward the interior of the furnace extend horizontally as shown in FIG. 5, or at an upwardly up to 20° inclined angle.

The formation of the insulating layer which covers the whole wall element without any gaps, is facilitated if the return bend 6, which connect the horizontally arranged cooling tubes to each other, are also provided with horizontally extending fins. Such a return bend 6' is illustrated in side view in FIG. 6 in which a pair of fins 7 and 7' are provided on the side of the return bend directed to the interior of the furnace. In addition to the fins 7 and 7' an intermediate fin 8 may also be provided in the region where the two branches of the return bend 6' abut against each other, as best shown in FIG. 7.

Figure 6:
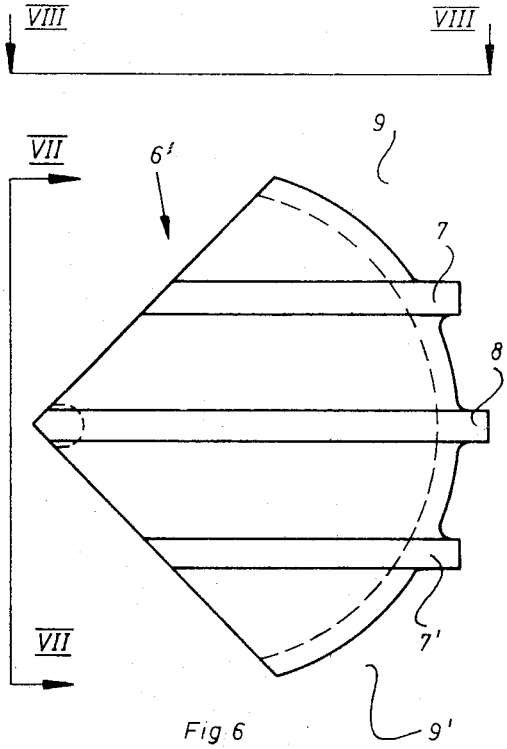
FIG. 6 is a side view of a return bend.
Figure 7:
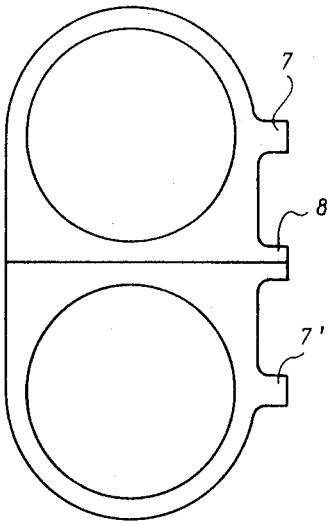
FIG. 7 is a view of the return bend shown in FIG. 6 as viewed in the direction of the arrows VII—VII of FIG. 6.
Figure 8:
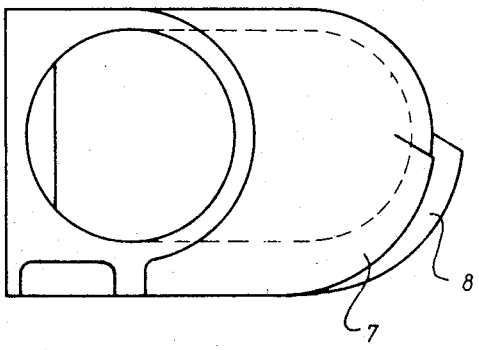
FIG. 8 is a top view of the return bend shown in FIG. 6 as viewed in the direction of the arrows VIII—VIII in FIG. 6.

FIG. 8 ilustrates the return bend 6' as viewed in the direction of the arrow VIII—VIII of FIG. 6 and this view clearly shows how the fins 7 and 8 which are directed toward the interior of the furnace will improve the adhesion of an insulating layer of refractory material and slag splattered thereon. The projection of the fins 7 and 8, as shown in FIG. 6, can also be chosen in such a manner that the wall elements may be combined to a box-type configuration whereby the open intermediate regions 9 may be closed by insulating masses.

Figure 9:
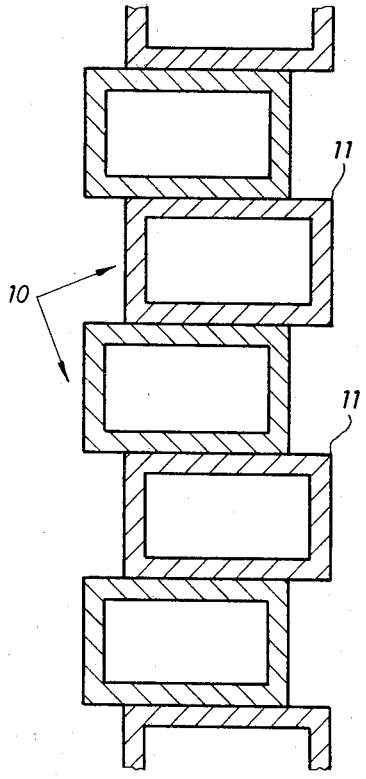
FIG. 9 is a partial section through a wall element in which this wall element is formed of rectangular tubes with every second tube offset with respect to the bordering tubes.

The desired effect to improve adhesion of an insulating layer and slag to the inner surface of the wall element can also be obtained when instead of circular fin tubes, as shown in FIGS. 4 and 5, the wall element is formed by rectangular tubes 10 as shown in section in FIG. 9, in which adjacent tubes 10, are offset in horizontal direction with respect to each other. The upper edges 11 of the rectangular tubes which are offset toward the interior of the furnace with regard to the bordering tubes form thereby the protrusions which increase the adhesion of an insulating layer to be applied thereto and that of the slag impinging thereon.

Figure 10:
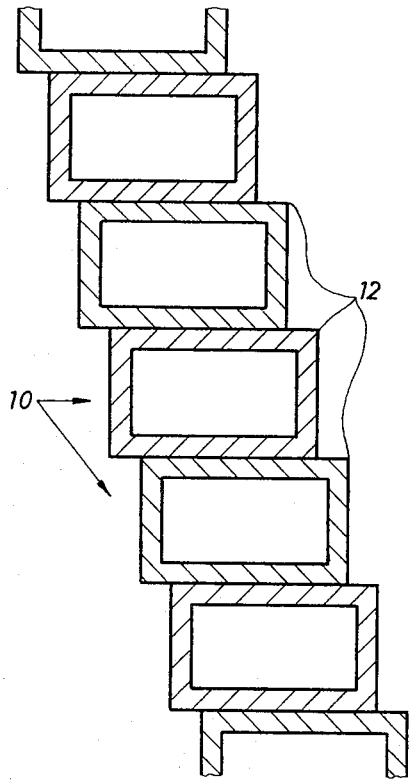
FIG. 10 is a partial section of a wall element likewise using rectangular tubes which are stepwise offset.

A further improved construction results if the protrusions are formed by a continuous stepwise or stairlike offsetting of the rectangular tubes with respect to each other as illustrated in FIG. 10, whereby the upper edges 12 of the rectangular tubes 10 form the desired protrusions which will increase the adhesion of the insulating layer to be applied to the inner surface of the wall element and that of the slag splattered thereon. As evident from FIG. 10 the number of protrusions is increased as compared with the arrangement as shown in FIG. 9. An additional advantage is obtained by the construction as shown in FIG. 10 in that the inner diameter of the furnace to be formed by the wall element stepwise increases in upper direction, whereby the charging volume for the furnace may be advantageously increased.

The return bends for connecting the ends of two superimposed tubes shown in FIGS. 9 and 10 are similar to the return bends shown in FIGS. 6–8, but of course, these return bends are constructed in accordance with the rectangular profiles of the tubes.

The rear side support, respectively the fixing of the tubes in the wall element, as well as the rear side mounting of the element in the furnace frame is known and is therefore not illustrated or described.

Figure 1:
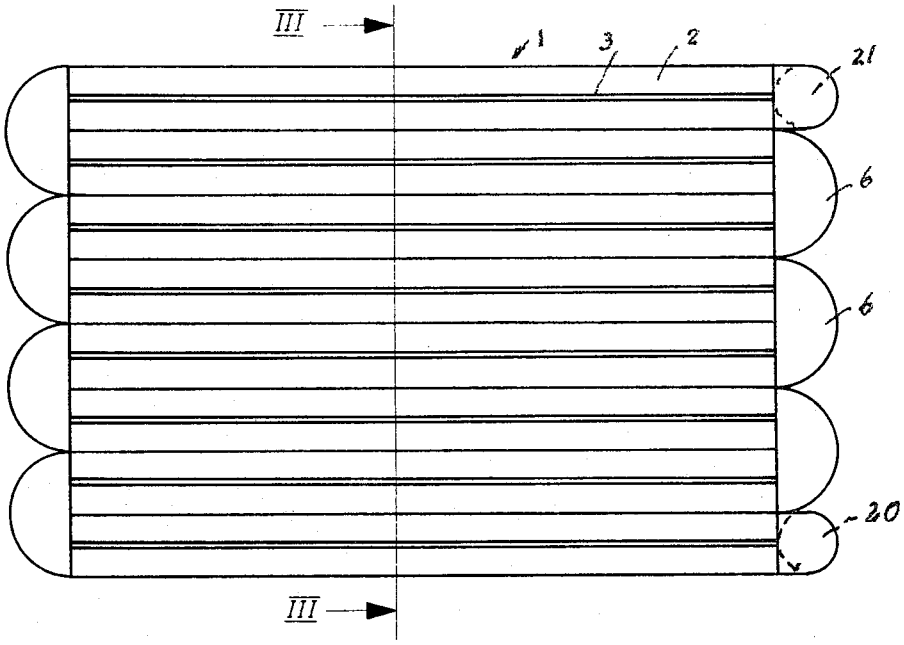
FIG. 1 is a side view of a water cooled wall element for melting furnaces formed of tubes and seen from the interior of the oven.
Figure 2:
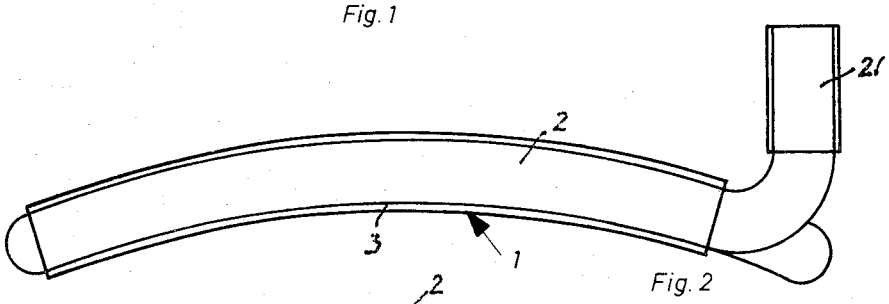
FIG. 2 is a top view of the wall element shown in FIG. 1.

Deviating from the cooling water circuit shown in FIG. 1, the cooling water circuit can also be arranged in such a manner that adjacent horizontally extending tubes in the cooling element are connected to two different cooling circuits.

Figure 11:
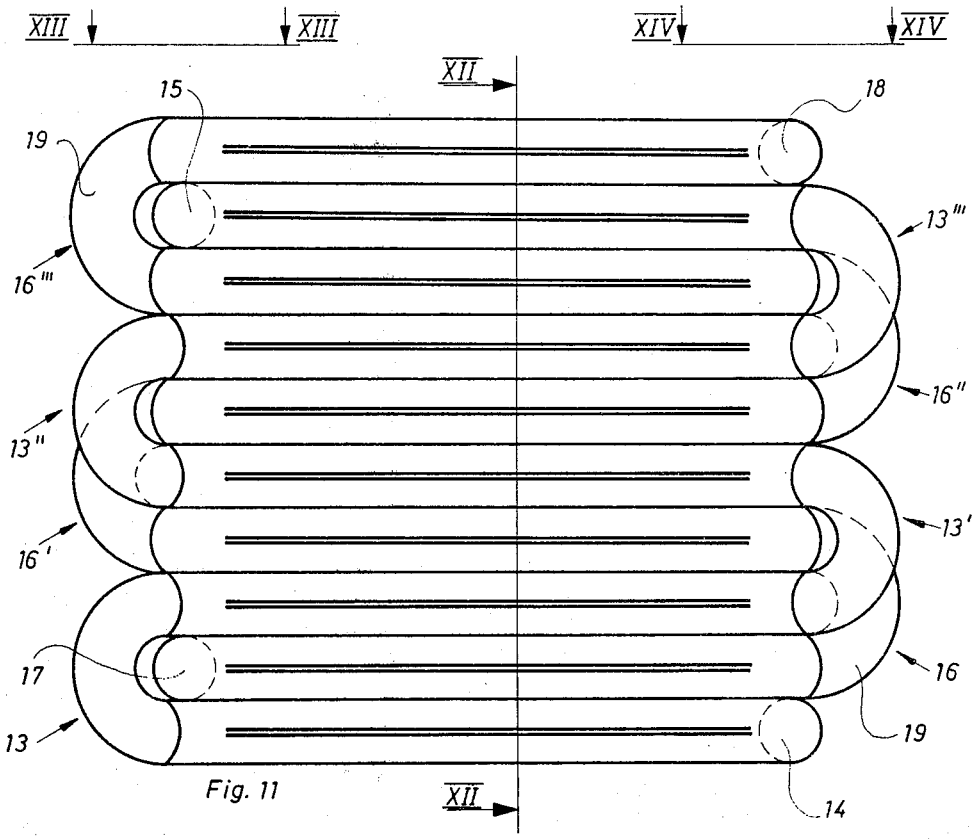
FIG. 11 is a water cooled wall element formed of tubes in which the latter are connected to form two different cooling water circuits.

Such an arrangement is shown in FIG. 11 in which a water cooled wall element formed of fin tubes is illustrated as seen from the interior of the oven in which one cooling circuit 13 with a cooling water inlet 14 and a cooling water outlet 15 is shown.

The second cooling water circuit designated with the reference numeral 16, has a cooling water inlet 17 and a cooling water outlet 18. The horizontally extending tubes of the wall element shown in FIG. 5 are fin tubes as shown in FIG. 4.

The return bends 19 connect in this construction not two directly superimposed tubes. The return bends 19 used in this construction are commercially available and provide very little flow-through resistance, however, this construction requires additional expenditure for the connection of the two cooling water circuits and the regulation thereof.

Figure 12:
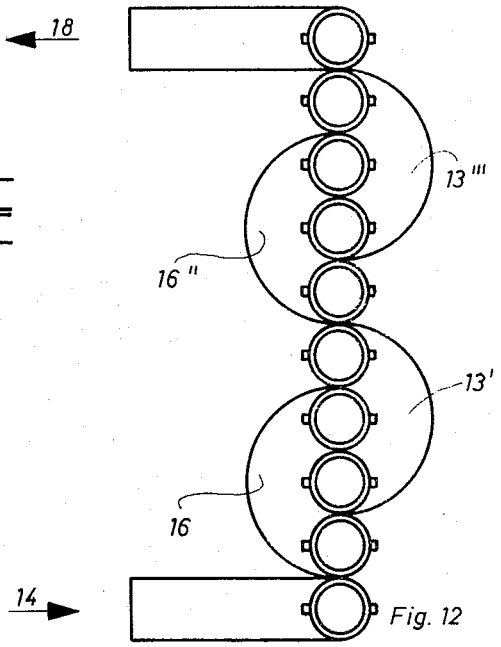
FIG. 12 is a section according to the line XII—XII of FIG. 11.

It will be noted that in this construction the return bends are in the region 13' and 13''' considerably further directed toward the interior of the oven than the return bends in the regions 16 and 16'', as clearly shown in FIG. 12. The return bends in the regions 13' and 13''' are therefore subjected to a higher thermal loading which is taken in consideration of the return bends.

Figure 13:
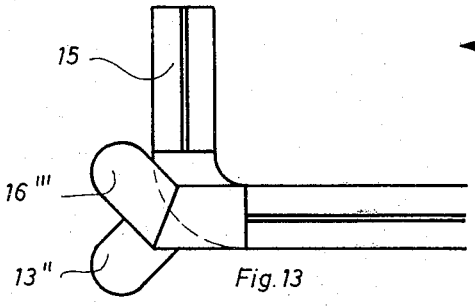
FIG. 13 is a view taken in the direction of the arrows XIII—XIII of FIG. 11.
Figure 14:
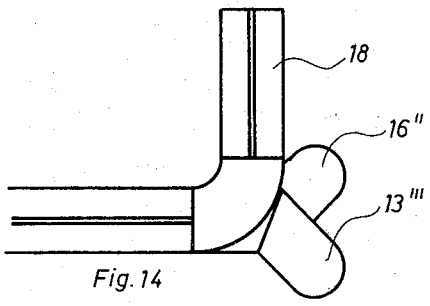
FIG. 14 is a view taken in the direction of the arrows XIV—XIV of FIG. 11.

To clarify the position of the return bends 19 the tube arrangement in the region of the cooling water circuit 13 and 16 is illustrated in FIGS. 13 and 14 in top view.

It will be understood that each of the elements described above, or two or more together, may also find a useful application in other types of water cooled wall elements formed from tubes for melting furnaces, especially arc furnaces for melting steel, differing from the types described above.

While the invention has been illustrated and described as embodied in a water cooled wall element formed from tubes for arc furnaces for melting steel, in which the tubes are provided with protrusions extending along the horizontally arranged tubes of the wall element to increase adhesion of an insulating layer of a refractory material to be applied to the surface of the wall element directed to the interior of the furnace, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. A water cooled wall element for at least partly replacing the casing of refractory material in melting furnaces, especially arc furnaces for melting steel, above the bath of molten material in the furnace, said water cooled wall element consisting of a plurality of parallel, horizontally extending superimposed fin tubes engaging each other in such a manner that the fins thereon form horizontally extending uninterrupted protrusions, with one of the fins on each tube projecting toward the interior of the furnace especially to improve adhesion of slag thereon and the other fin on each tube projecting toward the exterior of said furnace, said superimposed tubes including an uppermost end tube and a lowermost end tube; cooling water inlet means connected to one end tube; cooling water outlet means connected to the other end tube; and return bends connecting the ends of approximal tubes to each other.

2. A water cooled wall element as defined in claim 1, wherein said fins are spaced in vertical direction for a distance equal to the vertical dimension of the tubes.

3. A water cooled wall element as defined in claim 1, wherein said return bends are provided with protrusions on the surface thereof which, when the wall element is used in a furnace; forms the inner surface of the furnace.

4. A water cooled wall element as defined in claim 3, wherein said protrusions are constituted by elongated horizontally extending protrusions on said surface of said return bend.

5. A water cooled wall element as defined in claim 4, wherein each of said return bends comprises an upper branch and a lower branch and wherein each of said branches is provided with a horizontally extending elongated protrusion.

6. A water cooled wall element as defined in claim 5, wherein said return bends are additionally provided with an elongated horizontally extending protrusion intermediate the protrusions provided on said branches.

7. A water cooled wall element as defined in claim 1, wherein said parallel horizontally extending and vertically superimposed tubes are divided into two groups, with the uppermost tube of one group above and abutting against the uppermost tube of the other group and the lowermost tube of said one group above and abutting against the lowermost tube of the other group, and with said return bends respectively connecting the ends of the tubes of the respective group to each other so as to form in said wall element two different cooling water circuits.

8. A water cooled wall element as defined in claim 7, wherein the return bends connecting the ends of the tubes of one group are slightly inclined towards the surface of said wall element which when the wall element is used in a furnace forms the inner surface of the wall element, whereas the return bends connecting the tubes of the other group are inclined in the opposite direction.

9. A water cooled wall element as defined in claim 1, wherein said cooling water inlet means is connected to the lowermost tube and said cooling water outlet means is connected to the uppermost tube of the wall element.

10. A water cooled wall element for at least partially replacing the casing of refractory material in melting furnaces, especially arc furnaces for melting steel, above the bath of molten material in the furnace, said water cooled wall element comprising a plurality of parallel, horizontally extending superimposed tubes of rectangular cross section engaging each other and including an uppermost and a lowermost end tube, wherein every second of said vertically superimposed tubes is offset through at least one quarter of its width with respect to the adjacent tube to provide uninterrupted protrusions on that surface of the wall element which is directed towards the interior of the furnace to improve adhesion of slag splattered against said surface; cooling water inlet means connected to one of said end tubes; cooling water outlet means connected to the other of said end tubes; and return bends connecting approximal tubes to each other.

11. A water cooled wall element for at least partially replacing the casing of refractory material in melting furnaces, especially arc furnaces, for melting steel, above the bath of molten material in the furnace, said water cooled wall element comprising a plurality of parallel, horizontally extending superimposed tubes of rectangular cross section engaging each other and including an uppermost and a lowermost end tube, wherein each tube is offset through at least a quarter of its width with respect to the abutting tube toward the side of the wall element which forms the inner surface of the furnace, to provide uninterrupted protrusion on that surface of the wall element which is directed towards the interior of the furnace to improve adhesion of slag splattered against said surface and so that the inner width of the upper region of the furnace in which the wall element is used increases stepwise in upward direction; cooling water inlet means connected to one of said end tubes; cooling water outlet means connected to the other of said end tubes; and return bends connecting approximal tubes to each other.

* * * * *